United States Patent [19]

Magyar et al.

[11] Patent Number: 4,609,406

[45] Date of Patent: Sep. 2, 1986

[54] RUST CONVERSION COATINGS

[75] Inventors: Arpad M. Magyar, Conroe; James G. Newsome, The Woodlands, both of Tex.; Darrell W. Patton, Wichita, Kans.

[73] Assignee: Pennzoil Company, Houston, Tex.

[21] Appl. No.: 647,464

[22] Filed: Sep. 5, 1984

[51] Int. Cl.[4] ..... C23F 7/00

[52] U.S. Cl. ..... 134/2; 134/4; 252/174.23; 252/396; 252/DIG. 2; 106/14.13; 106/14.35; 427/156; 148/6.14 R

[58] Field of Search ..... 134/2, 4; 252/174.23, 252/174.24, 393, 396, DIG. 2, DIG. 3; 106/14.13, 14.35; 427/156; 148/6.14 R

[56] References Cited

U.S. PATENT DOCUMENTS

| | | | |
|---|---|---|---|
| 3,245,909 | 4/1965 | Lowe . | |
| 3,578,508 | 5/1971 | Pearlman . | |
| 4,014,814 | 3/1977 | Zecher . | |
| 4,086,182 | 4/1978 | Hengelhaupt . | |
| 4,240,925 | 12/1980 | Tait . | |
| 4,241,011 | 12/1980 | Hirozawa . | |
| 4,263,167 | 4/1981 | Mago . | |
| 4,324,675 | 4/1982 | Barthold . | |
| 4,325,744 | 4/1982 | Panayappan et al. | 134/4 |
| 4,424,079 | 1/1984 | Barabas | 134/4 |
| 4,451,296 | 5/1984 | Barabas | 134/4 |

*Primary Examiner*—Jeanette Hunter

*Attorney, Agent, or Firm*—Lowe, Price, LeBlanc, Becker & Shur

[57] ABSTRACT

A rust conversion composition comprises the reaction product of a polyhydroxybenzoic acid and a alkane polyol, in admixture with a film forming polymer, and water. The composition is applied to rusted, iron-containing surface, and allowed to dry to form a hard, moisture and corrosion resistant film. Alternatively, the film may be removed to produce an iron-containing surface free of rust.

16 Claims, No Drawings

RUST CONVERSION COATINGS

TECHNICAL FIELD

This invention relates to rust conversion coating compositions comprising the reaction products of alkane polyols and polyhydroxybenzoic acids, in combination with water and film-forming polymers. The compositions, when applied to a rusted metal surface, convert the rust to a stable, iron-containing complex. These coatings can then be removed to leave a rust-free metal surface, or may remain on the surface to provide a moisture and corrosion proof barrier.

BACKGROUND OF THE INVENTION

Corrosion inhibiting compositions and additives are known in the art, which contain a hydroxybenzoic acid component. For example, U.S. Pat. No. 4,014,814 to Zecher discloses corrosion inhibiting compositions comprising reaction products of polyhydroxybenzoic acids and phosphates. U.S. Pat. No. 3,578,508 to Pearlman, discloses compositions and methods related to the corrosion proofing of ferrous metal by a solution obtained by treating a chromite ore with gallic acid. U.S. Pat. No. 3,245,909 to Lowe discloses corrosion-inhibiting lubricating compositions containing 2,4-dihydroxybenzoic acid as a corrosion inhibitor. Finally, a series of patents issued to inventor Hirozawa et al, of which U.S. Pat. No. 4,241,011 is representative, disclose the use of hydroxybenzoic acid as a pH buffer and corrosion inhibitor for alkali metal silicate-containing antifreeze compositions.

The prior art also contains teachings of corrosion inhibiting compositions containing alkylene glycol components. One such teaching, U.S. Pat. No. 4,324,675, to Barthold et al, discloses antifreeze compositions containing corrosion inhibitors, wherein the alkylene glycol-based coolant contains an inhibitor such as nucleus-substituted benzoic acid. U.S. Pat. No. 4,240,925, to Tate, discloses a corrosion inhibiting composition containing glycols which can be used together with polyamines. Such compositions contain both a cathodic and an anodic corrosion inhibitor.

The prior art also discloses rust conversion compositions, one such composition, as disclosed in U.S. Pat. No. 4,086,182, to Hengelhaupt et al, being an aqueous dispersion or emulsion of a polymer with a reaction product of an aromatic oxycarboxylic acid and an acid anhydride or substituted acid anhydride.

SUMMARY OF THE INVENTION

It is an object of the present invention to provide an improved rust conversion composition.

It is a further object of this invention to provide a method for preparing the improved rust conversion composition.

A still further object of this invention to provide a method for removing rust from a metal surface by application of the improved rust conversion composition.

It is an even further object of this invention to provide a method of forming a corrosion and moisture proof coating on a rusted surface using the improved rust converting composition of the invention.

Other objects and advantages of the invention will become apparent as the description thereof proceeds.

In satisfaction of the foregoing objects, the present invention provides a rust conversion composition comprising the reaction products of a polyhydroxybenzoic acid with an alkane polyol, a film forming polymer, and water. The composition can be applied to a rusted, iron-containing surface, and will form a protective, moisture and corrosion resistant layer. Alternatively, the dried composition may be removed from the surface, leaving the surface free of rust.

The rust conversion coating is prepared by heating alkane polyol with polyhydroxybenzoic acid in an aromatic solvent in the presence of a catalyst, at an elevated temperature. The waters of condensation, aromatic solvent, and unreacted alkane polyol are removed, the product is dissolved in water, and the resulting solution mixed with a water dispersion of a film forming polymer.

DETAILED DESCRIPTION OF THE INVENTION

The present invention provides a novel rust conversion composition comprising the reaction product of an alkane polyol and a polyhydroxybenzoic acid, in admixture with a film forming polymer, and water. The composition is applied to a rusted surfce, and dries to form a moisture and corrosion resistant film. The composition acts to stop or slow the corrosion process by changing the self-propagating rust surface to a converted, neutralized, inactive substance.

The polyhydroxybenzoic acid constituent of the composition may be any common polyhydroxybenzoic acid, such as 3,4-dihydroxybenzoic acid, 4,5-dihydroxybenzoic acid, and 3,4,5-trihydroxybenzoic acid (gallic acid). The polyhydroxy benzoic acid may be described by the following general formula:

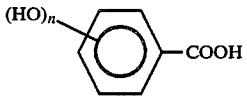

where n is an integer of 2 to 5. These hydroxybenzoic acids are offered only as examples, and the invention is not considered to be limited thereto.

The alkane polyol component may be any alkane polyol containing up to 7 carbon atoms and 2 to 3 hydroxyl groups. Ethylene glycol, propylene glycol, sorbitol, pentaerythritol, and tetraethylene glycol are preferred reactants. Substituted alkane polyols may also be used as well as mixtures.

The reaction product of the polyhydroxybenzoic acid and the alkane polyol are alkoxy-ether linked oligomeric compounds. A representative structure of such compounds is as follows:

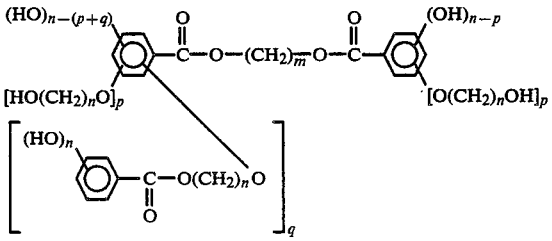

where m is an integer of 1 to 5 and n, p and q are integers of 5 or less.

It will be understood from the above general formula that the reaction of the polyhydroxybenzoic acid with the alkane polyol leads not only to ester formation between the benzoic acid and alcohol portion of the polyol, but ether formation also occurs on the hydroxy substituents with subsequent polymerization with the aid of the hydroxyl groups on the benzoic acid.

The rust conversion composition is prepared by initially reacting the alkane polyol with the polyhydroxybenzoic acid in an aromatic solvent in the presence of an acidic catalyst, at elevated temperature. Water of condensation is removed by azeotropic distillation. The aromatic solvent is decanted, and unreacted alkane polyol is removed by vacuum distillation. The resulting product is a brown, viscous material. In conducting this reaction, it is preferred to employ an excess of the alkane polyol reactant in order to promote the several reactions desired. It will be understood that the final structure of the polymeric type material can be controlled by careful control of the amounts of each of the reactants. The reaction is conducted at an elevated temperature and preferably at the boiling point of the aromatic solvent employed. In general, the temperature range may be stated to be from 75° C. to the boiling point of the solvent. Preferred solvents are the aromatic hydrocarbons such as benzene, meta- para- and ortho-xylene, toluene, and the chloro substituted derivatives such as chloro-benzene. Other solvents which may be used include dimethylsulfoxide and mixtures of these solvents. The preferred solvent is xylene. The reaction is conducted in the presence of a catalyst, preferably an organic acidic catalyst, and most preferably para-toluene sulfonic acid.

During the reaction, water of condensation is formed and must be removed. It is preferably removed by azeotropic distillation depending on the solvent used and can be collected from the distillation column by conventional means. On completion of this reaction, the resulting product is a generally viscous material, but which is then suitable for use in forming the rust conversion coatings of the present invention.

As indicated above, the conversion coating uses this reaction product in combination with the film forming polymer in a water solution. The film forming polymer is a water soluble film forming polymer of the type which is available commercially. Acrylic polymer latexes are particularly suitable for use in the invention. These latexes are available commercially under the Rhoplex and Acrysol tradenames by Rohm and Haas. These materials are mixtures of acrylic and methacrylic esters contained in a water solution. One such material is Acrysol I-62 which is a polyacrylate resin latex dispersion having an emulsifier system slightly acidic and, therefore, compatible with the alkane polyol-polyhydroxybenzoic acid reaction product. Depending on other physical requirements, such as flexibility, impact resistance, etc., of the films to be formed, a great variety of polymer and copolymer dispersions and combinations thereof can be used as long as compatibility and storage stability requirements are satisfied.

In forming the rust conversion coating, the reaction product of the alkane polyol and polyhydroxy benzoic acid is dissolved in water to form a product solution containing about 40–50 wt.% of the reaction product. This resulting solution is then mixed with the water dispersion of the film forming polymer. The resulting product will contain the reaction product in the film forming polymer dispersion in a concentration of about 5 to 20 wt. %.

It may also be desirable to adjust the viscosity of the resulting solution and this can be done conventionally by addition of a thickener of the types known to the art. Suitable thickeners are available commercially under the Polyox and Ucar tradenames from Union Carbide Corporation.

The resulting product solution is an aqueous solution which is generally white in color and preferably viscous, but this can, of course, be adjusted by the use of a thickener. The solution of the invention is therefore ready for use as a rust conversion coating. It has been found that when the solution is applied to a surface which contains iron-type rust, it will transform red rust into a solid black film. The film may be left on the rusted surface to provide a moisture and corrosion resistant coating or after drying, the film may be removed from the surface to provide an essentially rust free surface. The composition of the present invention is applied to the rust in sufficient amounts to form a coating on the rust contained on the iron and is permitted to remain on the rusted surface until it dries.

It is believed that the conversion coating agents stop or slow the corrosion process of the rusted surface by changing the self-propagating rusted surface to a converted, neutralized, inactive substance. Although the exact chemistry of this conversion process is not fully understood, and applicants are not bound by this theory, it is believed that the reaction product of the polyhydroxybenzoic acid with the alkane polyol compound reduces Fe (III) to Fe (II), and chelates the Fe (II) ions thereby forming stable complexes which immobilize these ions. The Fe (II) complex can then oxidize to a more stable Fe (III) complex.

There are a number of applications for the rust conversion coating compositions. Thus, the compositions can be used to treat automobile bodies, even if already rusted, or to precoat such bodies prior to standard rust-proofing operations. An aerosol product can be used as a rust neutralizer prior to touching up or major refinishing of painted surfaces of cars or other vehicles. A "liquid sandblast" type product can also be used on various surfaces to inactivate the rusting process.

The following examples are presented to illustrate the invention, but it is not to be considered as limited thereto. In the examples, parts are by weight unless otherwise indicated.

EXAMPLE 1

One hundred grams of 3,4,5-trihydroxybenzoic acid (gallic acid) and 200 grams of 1,2-ethanediol (ethylene glycol) were refluxed with 75 grams of xylene in the presence of 0.5 gram of p-toluenesulfonic acid as a catalyst. The waters of condensation were collected in a Dean Stark trap. At a point during the reaction when the temperature reached approximately 130° C., more xylene was added in order to facilitate azeotropic distillation and removal of the water. A total of 91.8 grams of distillate was removed from the trap in four fractions and the water content of each was determined by Karl Fischer titration. The total water of condensation, after a five-hour reaction time, was 39.3 grams. This corresponded to about 3.7 moles of water per mole of gallic acid condensed with the ethylene glycol.

After removal of the heat, the reaction mixture was allowed to cool to room temperature. The material showed two distinct layers, and the upper phase, containing mainly xylene, was decanted. In the following step, 34 grams of excess ethylene glycol was removed by vacuum distillation at a pressure of 4 mm Hg. and at a temperature ranging between 70° and 75° C. The reaction product was cooled under a vacuum and 123.9 grams of a brown, viscous substance was obtained. This material was readily water soluble.

A 5 wt.% water solution of the condensation product transformed the red rust on a steel panel into a black substance. The gallic acid-ethylene glycol condensation product also proved to be compatible with a polyacrylate resin latex dispersion (Acrysol I-62, Rohm and Haas Company) and formed black conversion coatings on rusted surfaces.

The vacuum distilled condensation product was submitted for infrared spectral analysis. The spectrum showed strong absorption bands in the vicinity of 5.9 and 9.0 microns. The 5.9 micron absorption band is characteristic of carboxylic ester functional groups, and this functionality was assigned to it, especially because the free acidity of the material was found to be only 0.72 mgs KOH/g that could be attributed to the residual p-toluenesulfonic acid catalyst. The absorption band in the vicinity of 9.0 microns is characteristic of ether functional groups, and this gave support to the theory that condensation and polymerization between the two reactants took place through the formation of ether linkages.

Gel permeation chromatography indicated the presence of compounds having molecular weights ranging from approximately 488 to 910. This suggests that the majority of condensation product was formed by the reaction of two to four gallic acid units with as many as seven or more ethylene glycol molecules.

EXAMPLE 2

Rusted 2×4-inch Metaspec test panels were prepared by placing them into 5% salt spray in an ASTM B 117 test cabinet. A mixture of Acrysol I-62 (90 grams), gallic acid ethylene glycol condensate reaction mixture of Example 1 (5 grams), and Polyox WSR-N-750 thickening agent, obtained from Union Carbide Corporation (0.5 grams) predissolved in water (5 grams) was prepared and applied to the rusted test panels. The red rust immediately started changing into a black conversion coating. After approximately one hour of drying time, a hard acrylic polymer coating was obtained and then overcoated with Pennzguard PZ-300 rustproofing compound, obtained from Pennzoil Company. The panel was exposed to 3,024 hours of ASTM B 117 salt spray testing. The panel removed at the end of the testing period showed rusty discoloration at the top of the overcoat; however, the conversion coating was found to be black and free of rust formation when a spatula was used to dig down toward the metal surface.

EXAMPLE 3

A process according to Example 1 was performed. Two hundred grams of gallic acid was reacted with 400 grams of ethylene glycol in the presence of p-toluenesulfonic acid as the catalyst. The reaction time was extended to 13 hours and a total of 93 grams of water condensate was collected. This corresponded to approximately 4.4 moles of water removed by the condensation reaction per mole of gallic acid. The product was more viscous than the product of Example 1, was still water soluble, showed the infrared absorption bands of esters and ethers, and formed a black conversion coating when applied to rusted steel panel surfaces. Gel permeation chromatography showed an average molecular weight of 643, ranging up to 1142.

EXAMPLE 4

An experiment was conducted according to the procedure in Example 1. The reaction of Example 1 was carried out to condense 3.7 moles of water per mole of gallic acid. A nitrogen purge was also employed during the reaction to produce a lighter colored reaction product. The product showed similar characteristics to the one obtained in Example 1.

EXAMPLE 5

An experiment was conducted to develop a conversion coating primer to be used prior to applying automobile touch up paints. The product would be contained in aerosol containers. Various blends of waterborne acrylic resins were prepared with the gallic acid-ethylene glycol condensation products. The blends thus obtained were thickened with Ucar SCT-100 (Union Carbide Corporation) to form products of sufficient viscosity to form films on vertical metal surfaces. The typical product contained about 94 to 95 wt.% of Acrysol I-62, Rhoplex LC-67, or blends thereof. The blends contained 5 wt.% of the conversion additive of Example 4 and 0.4 wt.% of the thickening agent. Such products were sprayed on rusted, lightly brushed steel panels. The coated panels were top coated with commercially available touch up paints, such as those marketed under the tradenames of Krylon and Duplicolor. The dry panels were exposed to ASTM B 117 salt spray testing. Some panels were removed after 1264 hours and some after 1600 hours of 5% salt spray exposure. Although the panels showed cracking of the top coat touch up paint surface, conversion was still complete, and the metal surface was still well protected.

EXAMPLE 6

The purpose of this experiment was to test the compatibility of gallic acid-ethylene glycol condensate products with an automotive acrylic lacquer paint. Acrylic lacquer (Dupont's 380 S Lucite Clear Coat Lacquer), 31 wt.%) was dissolved in Acrylic Lacquer Thinner (Dupont's 3661 S "Mid-Temp" Acrylic Thinner, 63 wt.%), and the ethylene glycol-gallic acid condensation product was added to the solution (6 wt.%). A blank lacquer solution containing no conversion additive was also prepared. Rusted steel panels were wire brushed, rinsed with water, and allowed to dry. The panels were then coated with the acrylic lacquer solutions, and after drying, were coated with Duplicolor Blue automotive spray paint. The panels were stored for three months, December through February, on the roof of a building in Shreveport, Louisiana. After three months, the panels coated with the Lucite solution containing no conversion additive showed breakthrough of rust penetrating the Duplicolor top coat, while the panels coated with the Lucite solution incorporating the ethylene glycol-gallic acid conversion coating additive were virtually free of rust. No cracking of the coatings was observed in this atmospheric exposure test.

EXAMPLE 7

The purpose of this example was to prepare a reaction product of gallic acid and 2,2'-oxydiethanol (diethylene glycol). The experimental procedure was similar to the one described in Example 1. Thirty-five and two-tenths grams (0.21 mole) of gallic acid and 87.6 grams (0.83 mole) of diethylene glycol were refluxed in 150 grams of xylene in the presence of 0.5 gram of p-toluenesulfonic acid as the catalyst. A reflux temperature of 137° C. was maintained for a reaction time of twelve hours. The waters of condensation were collected in a Dean Stark trap, weighed, and the water content was determined by Karl Fischer titration. One milliliter of concentrated sulfuric acid was added to the reaction mixture as an additional catalyst. A total of 4.5 moles of water per mole of gallic acid was collected during the next three to four hours of refluxing, as well as a subsequent vacuum distillation. Excess xylene was decanted from the reaction mixture prior to the vacuum distillation. The product obtained after the distillation was a viscous, water-soluble substance. When the product was mixed with a polymer latex, such as Acrysol I-62, and applied to rusted steel panels, the characteristic black conversion coatings were formed.

The infrared spectrum of the product showed the characteristic absorption bands of esters and ethers in the vicinity of 5.9 and 9.0 microns, respectively. Gel permeation spectroscopy indicated the presence of compounds with molecular weights ranging from 313 to 1365, with an average of approximately 785.

EXAMPLE 8

Forty-two and seven-tenths grams of gallic acid (0.25 mole) and 76.7 grams of 1,3-propanediol (1.03 moles) were refluxed in approximately 200 grams of xylene. 0.55 grams of p-toluenesulfonic acid was used as a catalyst. A reflux temperature of about 135° C. was maintained for a reaction time of eight hours. A total of 13.0 grams of water was collected and determined by Karl Fischer titration to correspond to 2.9 moles of water per mole of gallic acid. After decanting the excess xylene, the reaction mixture was vacuum distilled. The product was a viscous, water soluble substance which, when mixed with Acrysol I-62, formed a characteristic conversion coating on rusted steel panels.

The infrared spectrum showed the characteristic absorption bands of esters and ethers, and the gel permeation spectrogram indicated the presence of compounds with molecular weights ranging between 341 and 1456.

EXAMPLE 9

In this experiment, a condensation product of gallic acid and 1,2-propanediol (propylene glycol) was prepared. Thirty-six and one-tenth grams of gallic acid (0.21 moles) and 63.6 grams of propylene glycol (0.84 mole) were refluxed in about 150 grams of xylene in the presence of 0.68 grams of p-toluenesulfonic acid. A temperature of 132° C. was maintained for the 12-hour reaction time. A total of 18.4 grams of water was collected during the reaction which corresponded to 4.9 moles of water per mole of gallic acid. During subsequent vacuum distillation, an additional 0.56 grams of water were condensed. The product obtained was viscous and only partially soluble in water. It formed the characteristic black conversion coating when applied to rusted steel surfaces. Infrared spectrum analysis showed the absorption bands in the vicinity of 5.9 and 9.0 microns, and gel permeation chromatography indicated a molecular weight range between 352 and 1456.

EXAMPLE 10

The purpose of this experiment was to prepare a reaction product of gallic acid and sorbitol. Forty-two and six-tenths grams of gallic acid (0.25 mole) and 182.6 grams of sorbitol (1.0 moles) were refluxed in 300 grams of dimethyl sulfoxide with 0.5 grams of p-toluenesulfonic acid. One hundred fifty grams of xylene was added for the azeotropic removal of water formed in the reaction. The reflux temperature of 135° C. was maintained for 13.5 hours of reaction time. The waters of condensation were collected in the Dean Stark trap and weighed, and the water content of the distillate fractions was determined by Karl Fischer titration. A total of 14.0 grams of water was obtained during the reflux period, corresponding to 3.1 moles of water per mole of gallic acid. The reaction mixture was vacuum distilled to remove the xylene and the dimethyl sulfoxide. During the vacuum distillation, an additional 2.1 grams of water was collected, which increased the total amount of water obtained due to the condensation reaction to 16.1 grams (equivalent to 3.6 moles per mole of gallic acid). The product was a dark, viscous material, soluble in water, which, when dissolved in Acrysol I-62, formed characteristic black conversion coatings. Gel permeation chromatography suggested the presence of compounds ranging in molecular weight between 291 and 1469.

EXAMPLE 11

The purpose of this experiment was to prepare a reaction product of gallic acid and 2,2-bishydroxymethyl-1,3-propanediol (pentaerythritol). Forty-two and eight-tenths grams of gallic acid (0.25 mole) and 138 grams of pentaerythritol (1 mole) were refluxed in 306 grams of dimethyl sulfoxide solvent and 150 grams of xylene in the presence of 0.5 gram of p-toluenesulfonic acid. The reflux temperature of approximately 135° C. was maintained throughout the 20 hour reaction period. The waters of condensation were collected in the Dean Stark strap and weighed, and the water content was determined by Karl Fisher titration. The refluxing vapors consisted of a mixture of xylene, water, and dimethyl sulfoxide azeotrope, which, after condensing, separated into two layers. A total of 15.4 grams of water was collected during the reflux period which represents a ratio of 3.4 moles of water per mole of gallic acid. The reaction mixture was vacuum distilled to remove the dimethyl sulfoxide and the xylene. During the vacuum distillation, an additional 2.8 grams of water was collected, increasing the total amount of condensed water to 18.2 grams, which represented a ratio of 4.0 moles of water per mole of gallic acid. The total weight of material removed by distillation was 267 grams. The product was a dark, viscous, completely water-soluble material. When the product was mixed with Acrysol I-62 and applied to a rusted steel panel, the characteristic black conversion coating was formed. Infrared spectroscopy suggested the presence of ester groups, but the presence of ether groups was not definitely identifiable. Gel permeation showed the presence of compounds ranging in molecular weight between approximately 387 and 1293.

EXAMPLE 12

In this experiment, tetraethylene glycol and gallic acid were condensed. Gallic acid (0.25 mole) and tetraethylene glycol (1.0 mole) were refluxed in xylene in the presence of 0.5 grams of p-toluenesulfonic acid. The reflux temperature was approximately 145° C., and was maintained during 12.5 hours of reaction time. The total amount of water removed from the condensation reaction was 14.3 grams, representing 3.2 moles of water per mole of gallic acid. During the reaction, after about 6 hours of refluxing, 1 ml of concentrated sulfuric acid was added to the reaction mixture. Most of the xylene was decanted, and the reaction mixture was vacuum distilled to remove the unreacted tetraethylene glycol. The product was a viscous substance only partially soluble in water. When mixed with Acrysol I-62, it formed a black conversion coating on rusted steel panels. The molecular weight determined by gel permeation chromatography was 218 to 1069. Infrared spectra showed the presence of ester groups. The presence of ether groups could not be positively identified.

EXAMPLE 13

The purpose of this experiment was to prepare a condensation product of gallic acid and 1, 2,3-propanetriol (glycerol). Gallic acid (0.5 mole) and glycerol (2 moles) were refluxed in 150 grams of xylene for 12.5 hours, with 0.5 grams of p-toluenesulfonic acid. The reflux temperature was approximately 125° C. The waters of condensation were collected, and amounted to 40 grams, and the water content was determined to be 75.2 wt.%. Total weight of water was therefore 30.0 grams (1.67 moles) which represented a ratio of 3.3 moles of water per mole of gallic acid. Most of the xylene was decanted, and the remainder was removed by warming and blowing with nitrogen. The product was a dark, viscous material completely soluble in water. When this product was dissolved in Acrysol I-62 and applied to rusty steel panels, the characteristic black conversion coating was obtained. Infrared analysis showed the presence of ester and possibly ether groups. Gel permeation chromatography showed a range of molecular weights between 212 and 1140.

The invention has been described herein with reference to certain embodiments. However, as obvious variations thereon will become apparent to those skilled in the art, the invention is not considered to be limited thereto.

We claim:

1. A rust conversion coating comprising:

(a) the previously formed ester and ether reaction products formed by the reaction of an excess of an alkane polyol with a polyhydroxybenzoic acid wherein water of condensation is removed as the ester and ether products are formed during the reaction;

(b) a film forming polymer; and (c) water.

2. A rust conversion coating according to claim 1 wherein the alkane polyol contains up to 7 carbon atoms and 2 to 3 hydroxyl groups.

3. A rust conversion coating according to claim 1 wherein the polyhydroxy benzoic acid is of the following formula:

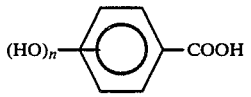

wherein n is an integer of 2 to 5.

4. A rust conversion coating according to claim 3 wherein the polyhydroxybenzoic acid is gallic acid.

5. A rust conversion coating according to claim 2 wherein the alkane polyol is ethylene glycol.

6. A rust conversion coating according to claim 1 wherein the film forming polymer is a polyacrylate polymer.

7. A rust converting composition comprising 5–10 wt.% of a reaction product of polyhydroxybenzoic acid and alkylene glycol, a film forming polymer, and the balance water.

8. A method of preparing the composition of claim 1 wherein an excess of an alkane polyol is reacted with a polyhydroxybenzoic acid in the presence of an aromatic solvent and an acidic catalyst, the waters of condensation produced thereby are removed, the aromatic solvent and unreacted alkane polyol are removed by vacuum distillation, and the resulting reaction product is mixed with water and a film forming polymer.

9. A method according to claim 8 wherein the organic solvent is xylene.

10. A method according to claim 8 wherein the polyhydroxybenzoic acid is gallic acid.

11. A method according to claim 8 wherein the alkane polyol is ethylene glycol.

12. A method according to claim 8 wherein the film forming polymer is a polyacrylate.

13. A method of removing rust from rusted, iron-containing surfaces which comprises applying to the rusted surface a coating comprising the composition of claim 1, and permitting the coating to dry to a hard film surface.

14. A method according to claim 13 wherein the hard film surface is subsequently removed, leaving a rust-free iron containing surface.

15. A rust conversion coating according to claim 1 wherein the reaction product of the alkane polyol and polyhydroxy benzoic acid comprises esters formed by reaction between the benzoic acid portion and alcohol portion of the polyol, and ethers formed by reaction of the hydroxy substituents with subsequent polymerization.

16. A rust conversion coating according to claim 15 wherein the chemical structure of the reaction product is as follows:

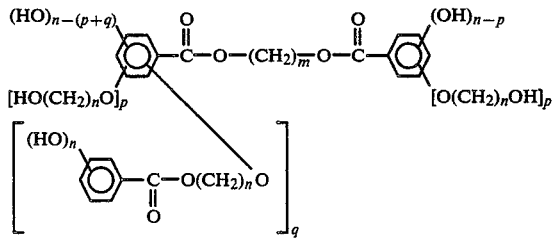

where m is an integer of 1 to 5, and n, p and q are integers of 5 or less.

* * * * *